US009484683B1

(12) United States Patent
Wang

(10) Patent No.: US 9,484,683 B1
(45) Date of Patent: Nov. 1, 2016

(54) CONDUCTIVE TERMINAL

(71) Applicant: Green Idea Tech Inc., Mahe (SC)

(72) Inventor: Chuan-Sheng Wang, Tainan (TW)

(73) Assignee: GREEN IDEA TECH INC., Mahe (SC)

( * ) Notice: Subject to any disclaimer, the term of this patent is extended or adjusted under 35 U.S.C. 154(b) by 0 days.

(21) Appl. No.: 15/054,582

(22) Filed: Feb. 26, 2016

(30) Foreign Application Priority Data

Apr. 9, 2015 (TW) ..... 104205284 U

(51) Int. Cl.
*H01R 13/44* (2006.01)
*H01R 13/696* (2011.01)

(52) U.S. Cl.
CPC ..... *H01R 13/696* (2013.01)

(58) Field of Classification Search
CPC ..... H01R 13/447; H01R 13/707
USPC ..... 439/135–141, 188, 911
See application file for complete search history.

(56) References Cited

U.S. PATENT DOCUMENTS 3,990,758 A * 11/1976 Petterson ..... H01R 13/4536 439/138
6,948,846 B2 * 9/2005 Engel ..... G01K 3/14 361/42
7,510,412 B1 * 3/2009 Valentin ..... H01R 13/4534 439/137
7,527,508 B1 * 5/2009 Lee ..... H01R 13/4534 439/137
8,062,072 B2 * 11/2011 Ziobro ..... F21S 6/003 439/650

FOREIGN PATENT DOCUMENTS

TW I371053 8/2012
TW M477079 4/2014

* cited by examiner

*Primary Examiner* — Phuongchi T Nguyen
(74) *Attorney, Agent, or Firm* — Muncy, Geissler, Olds & Lowe, P.C.

(57) ABSTRACT

The present invention discloses a conductive terminal including two conductive members or further comprising a hot melt fixing member. Each conductive member is provided with a groove which is concaved in from an edge of the host conductive member. The grooves on the two conductive members are opposite to each other and a gap is maintained between the two conductive members by an elastic force between the conductive members. The hot melt fixing member is put into the grooves of the two conductive members and is combined on the conductive members to overcome the elastic force, enabling the two conductive member to form contact limit, the hot melt fixing member to be damaged when overheat, and the two conductive members to be opened by the elastic force to form open circuit. The conductive member can be applied to overheat protection of a plug and a socket.

7 Claims, 11 Drawing Sheets

CONDUCTIVE TERMINAL

BACKGROUND OF THE INVENTION (a) Field of the Invention

The present invention relates to a conductive terminal, and more particularly to a conductive terminal which includes two conductive members, with each conductive member being provided with a groove which is concaved in from an edge of the host conductive member, and the two conductive members being combined with a hot melt fixing member, so that the two conductive members form contact limit to constitute an overheat protection structure for a path. In overheating, the hot melt fixing member is damaged that the two conductive members are opened by an elastic force to form open circuit.

(b) Description of the Prior Art

To avoid current overload, short circuit or overheating to a circuit, a wire fuse or circuit breaker will be usually disposed on the circuit, such that the wire fuse will have melt fracture by high temperature when the temperature of the circuit is too high or metallic spring leaves of the circuit breaker will trip when the current of the circuit is too large, so that the circuit can form open circuit and power off, thereby keeping the safe use of electricity.

Regarding to a related prior art of the wire fuse structure, there is a Taiwanese invention patent publication No. 1371053, "Thermal Fuse Connection Structure." The thermal fuse includes primarily two terminals which are connected together to form a path, and a hot melt metal which is combined on the two terminals. Under the condition of current overload, circuit overheat or too high the ambient temperature, the hot melt metal will have melt fracture by heat, and the two terminals will not be connected together to form an open circuit state.

However, in the prior art, the hot melt metal is a conductive material. Therefore, when the hot melt metal shows melt fracture, if part of the hot melt metal is adhered on the two terminals, the adhered hot melt metal may easily cause miscontact between the two terminals, so that the circuit cannot power off completely. In addition, the hot melt metal that shows melt fracture can be ejected by the two terminals that are opened to form open circuit, and the hot melt metal showing melt fracture may collide with other object to form miscontact and result in short circuit, which is still dangerous in use.

A Taiwanese new utility model patent No. M477079, "Overheat Failure Safety Structure, a Socket and a Plug with the Overheat Failure Safety Structure," employs an insulative stopper to connect two conductive members to form a path. When the circuit is overheated, the insulative stopper will have melt fracture, which allows the two conductive members to be opened by an elastic force and thus to form open circuit. The stopper is provided with a first insulative part and an opposite second insulative part, and utilizes a connection part to connect the first insulative part with the second insulative part, forming a U-shaped appearance to have an open end at which the two conductive members are tightly clipped.

By a practical test, it is found that in the U-shaped stopper, as the arm of force is longer at the location where the first insulative part and the second insulative part are more away from the connection part, the clamping force there will be weaker, which easily causes a partial ill contact to the two conductive members. It means that a better clamping force is easily available at the location where the two conductive members are close to the connection part of the U-shaped stopper; whereas, a better clamping force is not easily available at the location where the two conductive members are away from the connection part of the U-shaped stopper. Therefore, it is necessary to further improve the clamping between the U-shaped stopper and the two conductive members, so that the two conductive members can be more tightly contacted.

SUMMARY OF THE INVENTION

Accordingly, to solve the abovementioned issues, the present invention discloses a conductive terminal which is used in association with a hot melt fixing member. The conductive terminal includes two conductive members, each conductive member is provided with a groove, the groove is concaved in from an edge of the host conductive member and is opposite to the other groove. A gap is maintained between the two conductive members by an elastic force between the two conductive members. The hot melt fixing member is put in the grooves of the conductive members and is combined on the conductive members to overcome the elastic force, enabling the two conductive members to form contact limit. The hot melt fixing member is damaged when overheat, so that the two conductive members can be opened by the elastic force to form open circuit.

In addition, the groove is in a width of 0.1~1.3 cm.

Furthermore, the width of groove is 0.8 cm.

Moreover, the extended length for the part of the hot melt fixing member put into the grooves is not larger than the depth of the grooves.

The present invention is provided with following effects that:

1. The hot melt fixing member is put into the grooves of the conductive members to tightly clip and fix the conductive members. This method will have sufficient rigidity of connection to combine and position the two conductive members of the circuit to be protected.
2. The hot melt fixing member is put into the grooves of the conductive members and preferably, the extended length of the part of the hot melt fixing member put into the grooves is not larger than the depth of the grooves. Therefore, when the part of the hot melt fixing member put into the grooves is damaged by heat, it can assure that two sides of the hot melt fixing member are subjected to the elastic force between the conductive members uniformly and are ejected, so that the two conductive members can be opened actually and the circuit can power off.
3. The grooves on the conductive members are concaved in from the edges of the host conductive members, facilitating a user to put the hot melt fixing member into the grooves directly. In addition, by the grooves on the two conductive members, the connection member of the hot melt fixing member can be deeply disposed in the grooves, so that after the hot melt fixing member has been assembled, the two stoppers will not be too far away from the connection member, which avoids resulting in a too long arm of force and enables the two conductive members to be clamped more uniformly.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
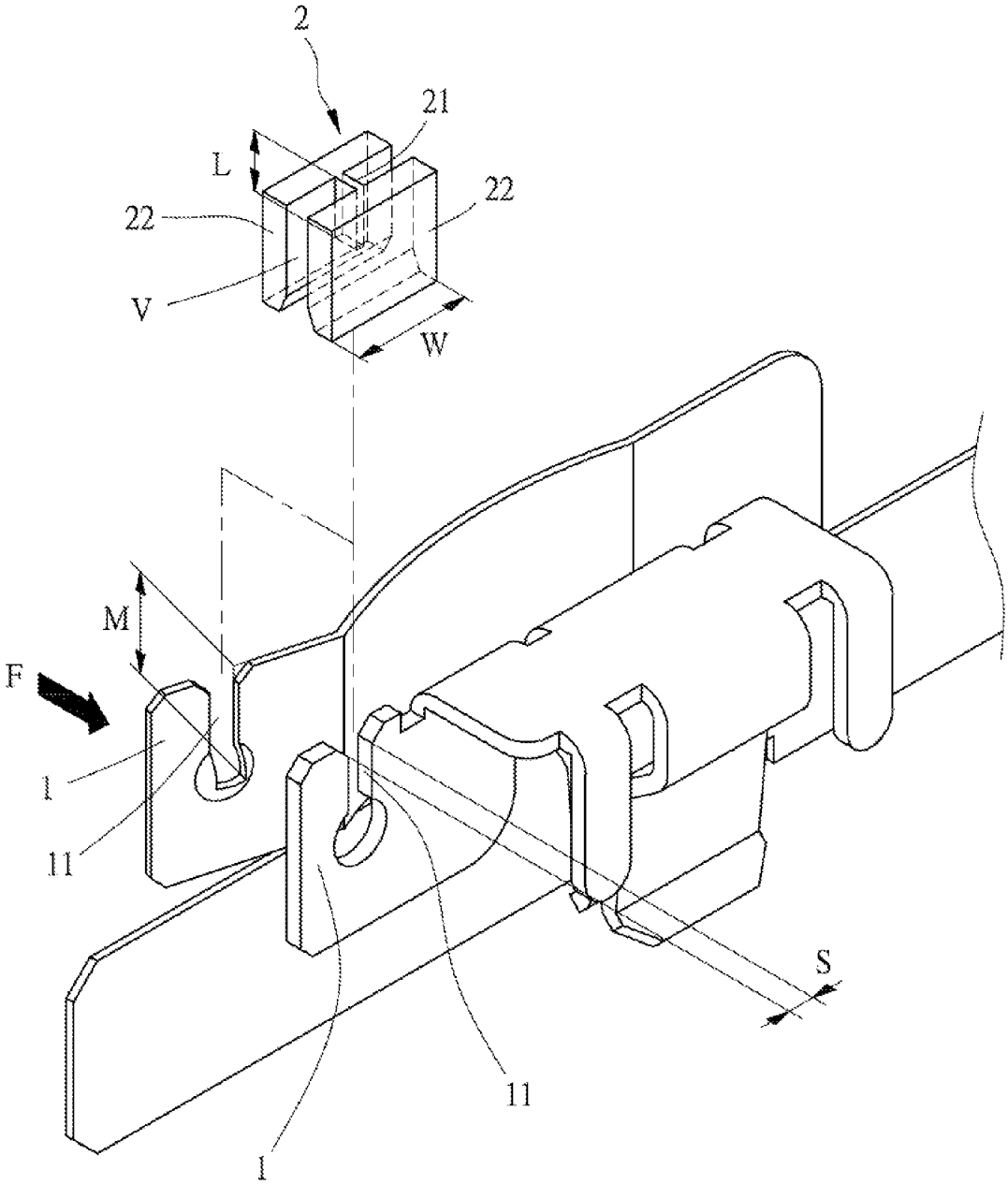
FIG. 1 shows a three-dimensional exploded view of two conductive members and a hot melt fixing member of an embodiment of the present invention.
Figure 2:
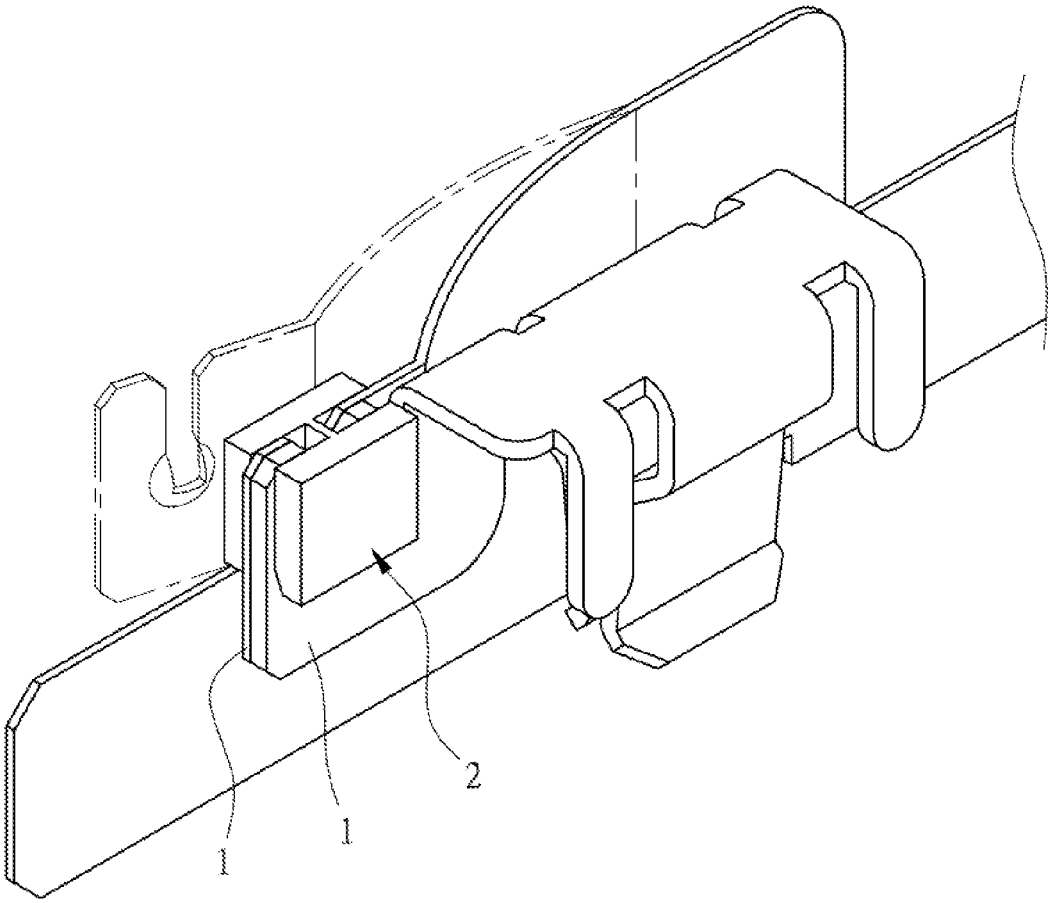
FIG. 2 shows a three-dimensional assembly view of the two conductive members and the hot melt fixing member of the embodiment of the present invention.
Figure 3:
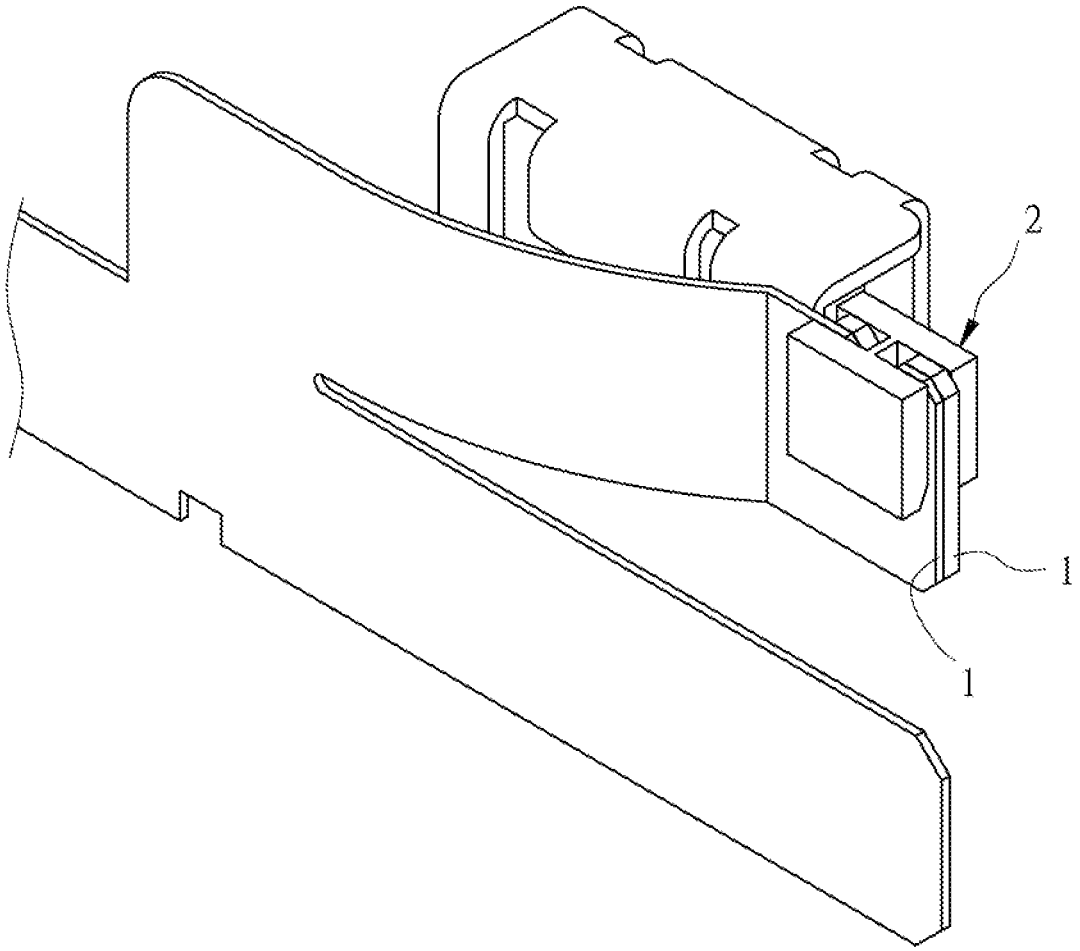
FIG. 3 shows a three-dimensional assembly view along another direction of the two conductive members and the hot melt fixing member of the embodiment of the present invention.

Referring to FIG. 1, an embodiment of the present invention comprises two conductive members 1. Each conductive member 1 is provided with a groove 11, and each groove 11 is concaved in from an edge of the host conductive member 1. The grooves 11 on the two conductive members 1 are opposite to each other, and a gap is maintained between the two conductive members 1 by an elastic force. The groove 11 is provided with a width S which is preferably between 0.1 cm and 1.3 cm. In the present embodiment, the groove width S is 0.8 cm.

Referring to FIGS. 1 to 4, the present embodiment further includes a hot melt fixing member 2. The hot melt fixing member 2 is provided with a connection member 21 and two stoppers 22 which are combined at two ends of the connection member 21. A holding space V is defined between the two stoppers 22. Two conductive members 1 are first close to and contact with each other by an external force F, and then the connection member 21 of the hot melt fixing member 2 is crossed over in the grooves 11 of the two conductive members 1, so that the two conductive members 1 can be contained in the holding space V. The thickness of the connection member 21 is about the same as the groove width S, and the grooves 11 on the two conductive members 1 are concaved in from the edges of the two host conductive members 1, which facilitates a user to put the connection member 21 of the hot melt fixing member 2 into the grooves 11 directly. In addition, the extended length L of the connection member 21 is not larger than the depth M of the grooves 11. The two stoppers 22 are provided respectively with a working depth W which is larger than the groove width S. Therefore, when the two conductive members 1 are contained in the holding space V, the two stoppers 22 can be abutted respectively at opposite outer sides of the two conductive members 1, allowing the two conductive members 1 to form contact limit to form open circuit. The abovementioned grooves 11 are concaved in from the edges of the conductive members 1, and the connection member 21 of the hot melt fixing member 2 can be deeply disposed in the grooves 11. Therefore, after the hot melt fixing member 2 has been assembled, the two stoppers 22 will not be too far away from the connection member 21 and thus will not have a too long arm of force. It means that the clamping force will not be degraded excessively at the location where the two stoppers 22 are away from the connection member 21, thereby enabling the two conductive members 1 to be clamped more uniformly.

Figure 4:
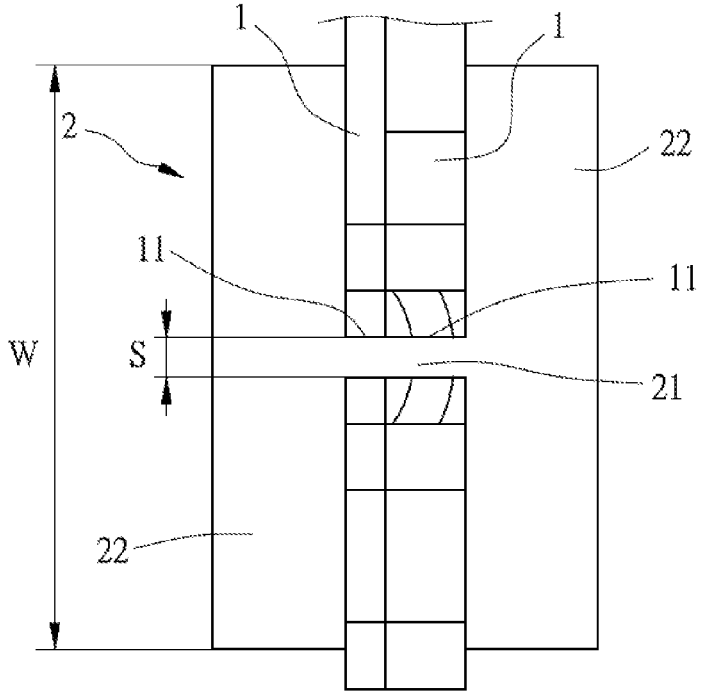
FIG. 4 shows a schematic view of combining the hot melt fixing member on the two conductive members, allowing the two conductive members to form contact limit, according to the embodiment of the present invention.

Referring to FIG. 4, in the abovementioned method, the connection member 21 is put into the grooves 11 of the two conductive members 1 which are then tightly clipped and fixed by the stoppers 22. This method is provided with sufficient rigidity of connection to combine and position the two conductive members 1 of the circuit to be protected.

Figure 5:
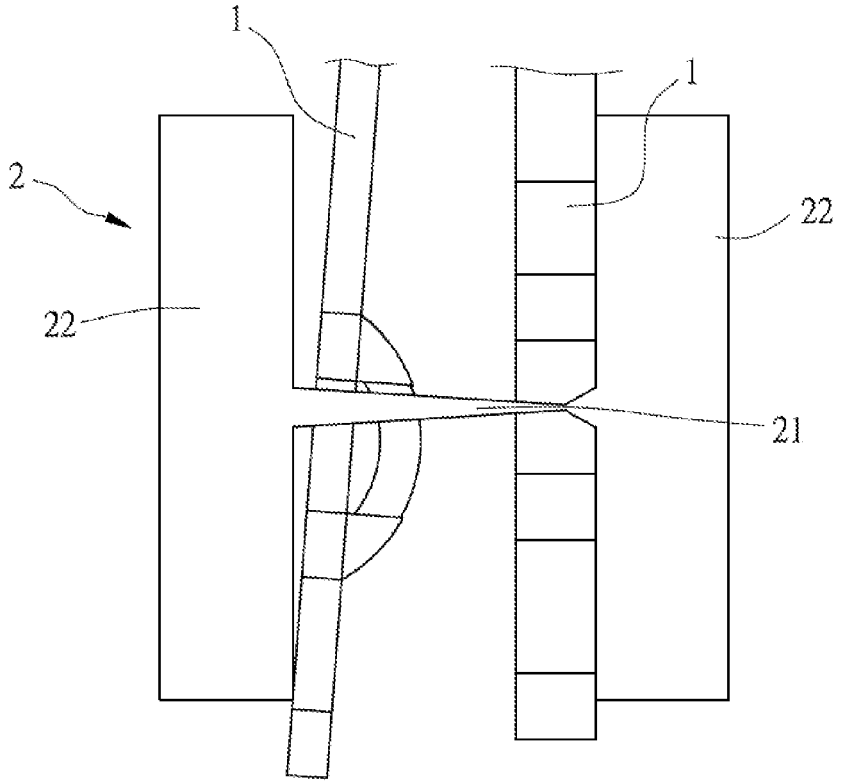
FIG. 5 shows a schematic view of that the two conductive members are opened by an elastic force as the hot melt fixing member melts down to reduce a force of constraint, when the circuit to be protected is overheated, according to the embodiment of the present invention.
Figure 6:
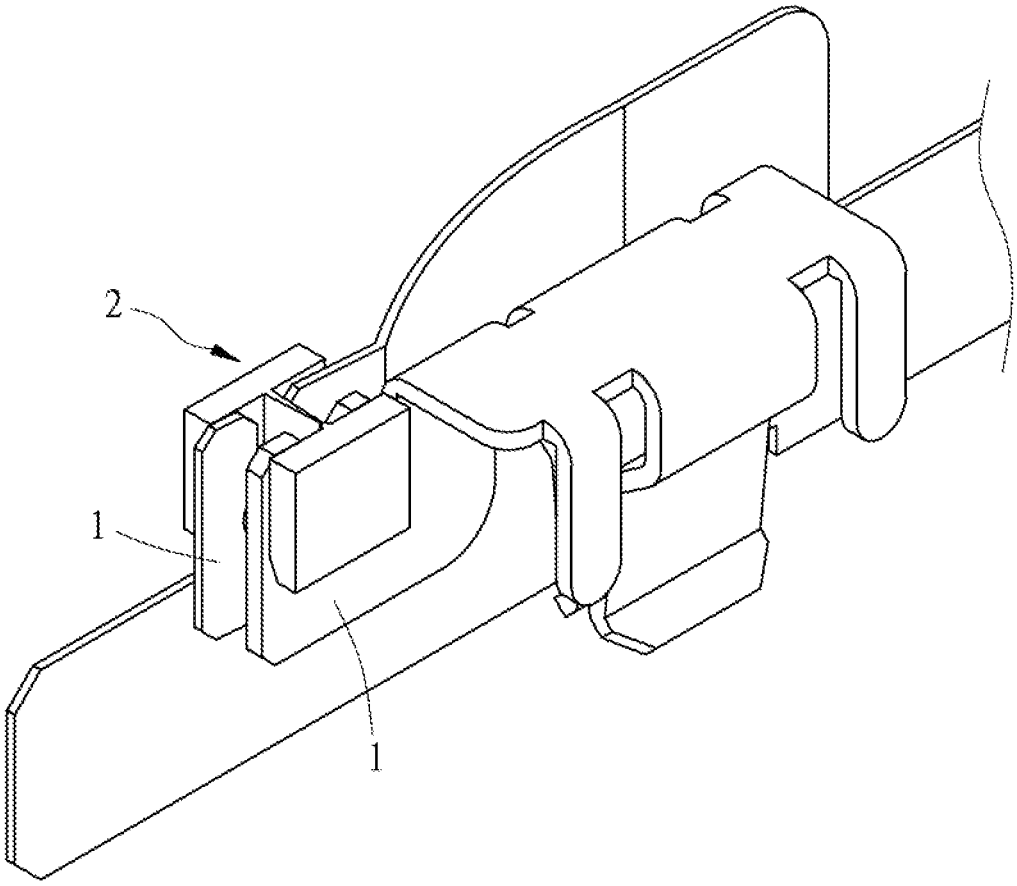
FIG. 6 shows a three-dimensional view of appearance of that the two conductive members are opened by the elastic force as the hot melt fixing member melts down to reduce the force of constraint, when the circuit to be protected is overheated, according to the embodiment of the present invention.

Referring to FIG. 5 and FIG. 6, when current or voltage overload occurs in the circuit to be protected, resulting in temperature rise and overheat to the two conductive members 1, such as when temperature rises to about 130° C. or 160° C., the hot melt fixing member 2 will be melted and soften by heat to reduce the force of constraint. At this time, the conductive members 1 will be opened to form open circuit due to the predetermined elastic force between the two conductive members 1, which avoids causing fire by overheat. The thickness of the connection member 21 is about the same as the groove width S described in FIG. 4, which facilitates combining the hot melt fixing member 2 with the two conductive members 1 stably. In addition, the thickness of the connection member 21 is between 0.1 cm and 1.3 cm, which assures that when the connection member 21 is soften by overheat, the elastic force between the two conductive members 1 is sufficient to overcome the force of constraint to eject the conductive members 1. The connection member 21 is put into the grooves 11 of the two conductive member 1, and the extended length of the connection member 21 is not larger than the depth of the grooves 11. Therefore, when the connection member 21 is damaged by heat, the two stoppers 22 can be assured to be ejected by being subjected to the elastic force between the two conductive members 1 uniformly, so that the two conductive members 1 can be opened actually and the circuit can power off.

Figure 7:
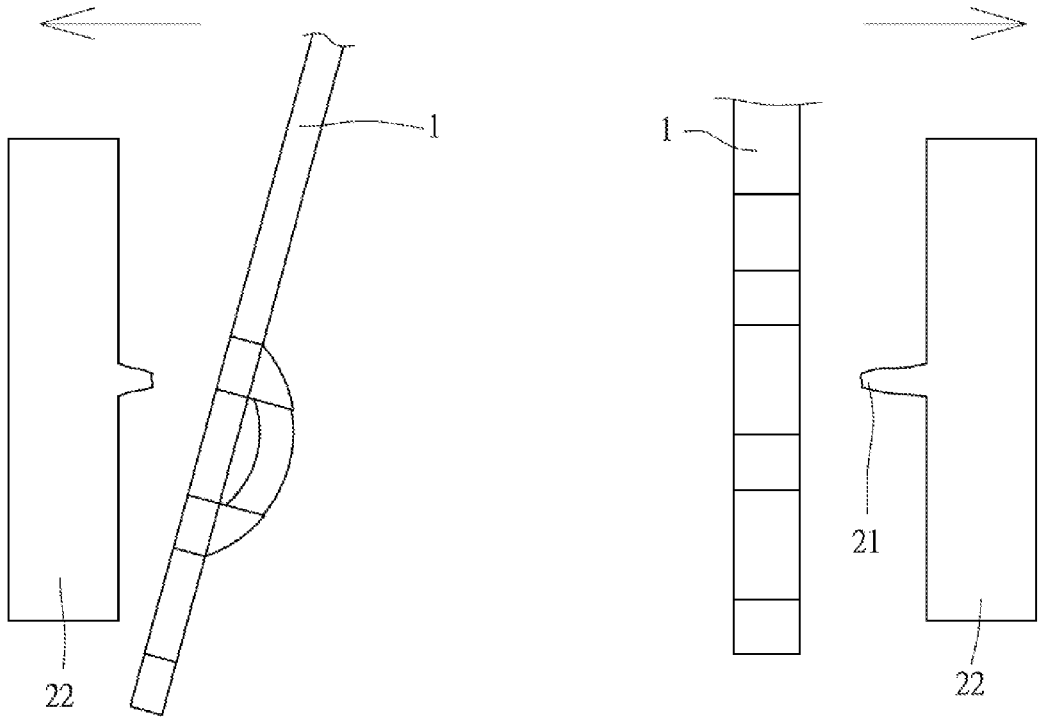
FIG. 7 shows a schematic view of that the two conductive members are opened by the elastic force as the hot melt fixing member melts and fractures, when the circuit to be protected is overheated, according to the embodiment of the present invention.
Figure 8:
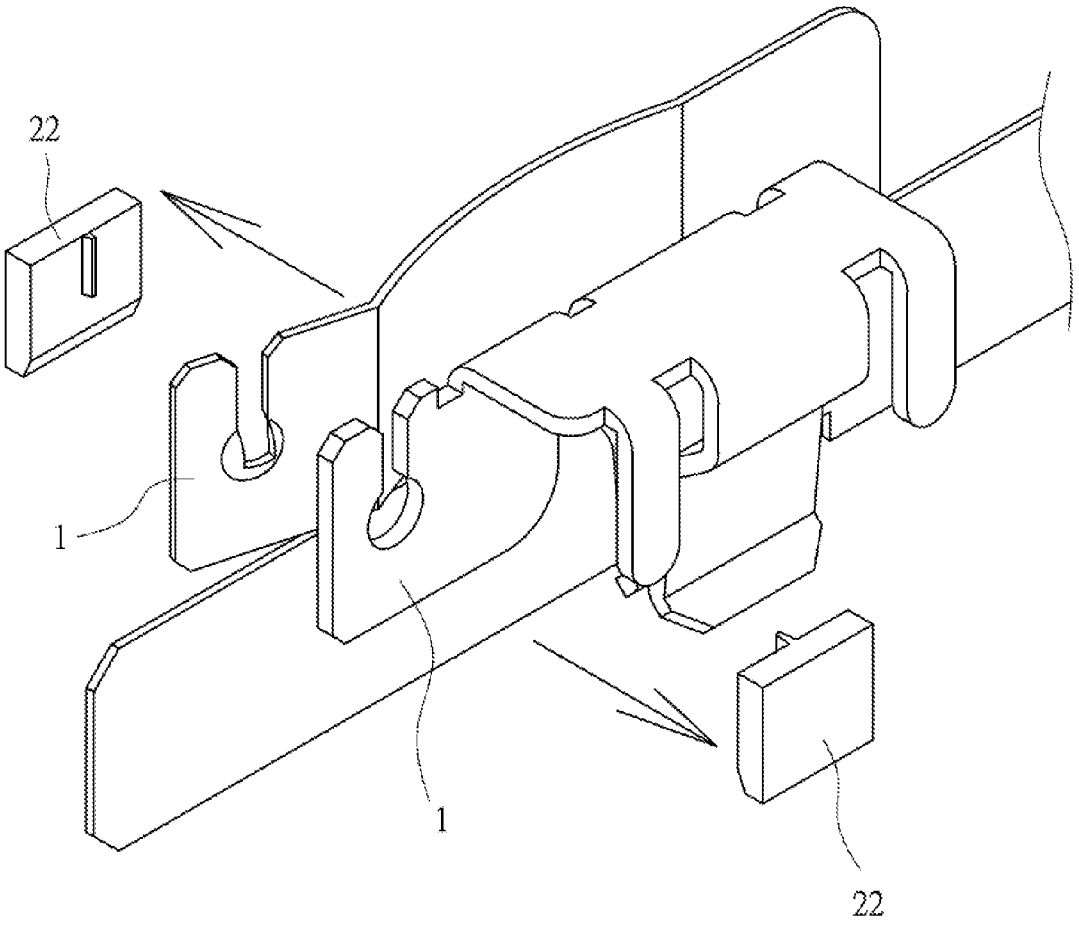
FIG. 8 shows a three-dimensional view of appearance of that the two conductive members are opened by the elastic force as the hot melt fixing member melts and fractures, when the circuit to be protected is overheated, according to the embodiment of the present invention.

The abovementioned hot melt fixing member 2 is preferably made of an insulative material. Referring to FIG. 7 and FIG. 8, even when the connection member 21 is melted and fractured to eject the two stoppers 22 freely, the insulative material of the hot melt fixing member 2 can prevent from contacting with ambient electronic elements by mistake to cause short circuit, thereby assuring the safety after power-off.

Figure 9:
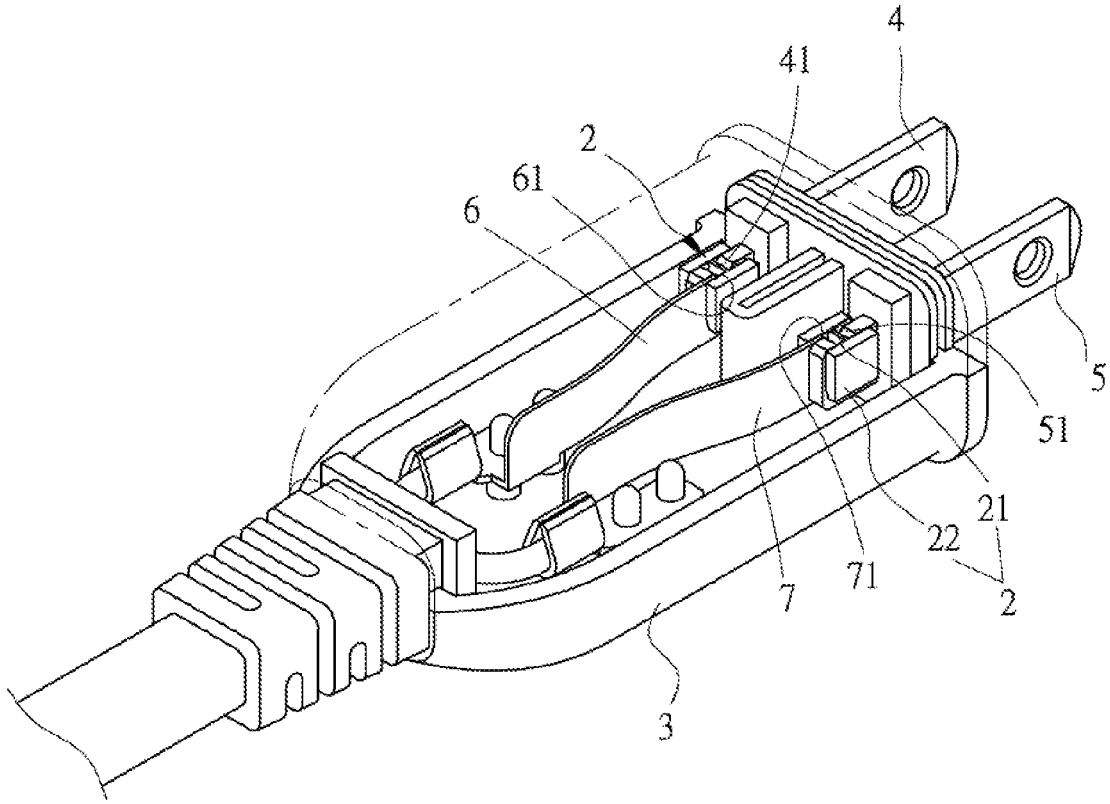
FIG. 9 shows a schematic view of that the present invention is applied to a plug, with that a live wire pin and the live wire extend along a same direction, whereas a neutral wire pin and the neutral wire extend along a same direction.

Referring to FIG. 9, the present invention is applied to overheat protection of a plug, and the plug of the present embodiment includes an insulative body 3, a live wire pin 4, a neutral wire pin 5, a live wire 6 and a neutral wire 7. The live wire pin 4 and the neutral wire pin 5 are disposed in the insulative body 3 and protruded out of the insulative body 3. The live wire pin 4 and the neutral wire pin 5 are provided with a first groove 41(51) which is concaved in from an edge of the live wire pin 4 and the neutral wire pin 5. The live wire 6 and the neutral wire 7 correspond respectively to the live wire pin 4 and the neutral wire pin 5. The live wire 6 and the neutral wire 7 are provided with a second groove 61(71) corresponding to the first groove 41(51). The second groove 61(71) is concaved in from an edge of the live wire 6 and the neutral wire 7. The live wire pin 4 and the live wire 6 extend along a same direction; whereas, the neutral wire pin 5 and the neutral wire 7 extend along a same direction.

By putting the connection member 21 of the hot melt fixing member 2 into the first groove 41 and the second groove 61 of the live wire pin 4 and the live wire 6, and using the stoppers 22 of the hot melt fixing member 2 to restrain the live wire pin 4 and the live wire 6, the live wire pin 4 and the live wire 6 can contact with each other to form a path. In addition, by putting the connection member 21 of the hot melt fixing member 2 into the first groove 51 and the second groove 71 of the neutral wire pin 5 and the neutral wire 7, and using the stoppers 22 of the hot melt fixing member 2 to restrain the neutral wire pin 5 and the neutral wire 7, the neutral wire pin 5 and the neutral wire 7 can contact with each other to form a path. The connection member 21 will be melted when overheat, allowing the live wire pin 4 and the live wire 6 to open, and the neutral wire pin 5 and the neutral wire 7 to open by an elastic force between the live wire pin 4 and the live wire 6, as well as an elastic force between the neutral wire pin 5 and the neutral wire 7, thereby forming open circuit.

Figure 10:
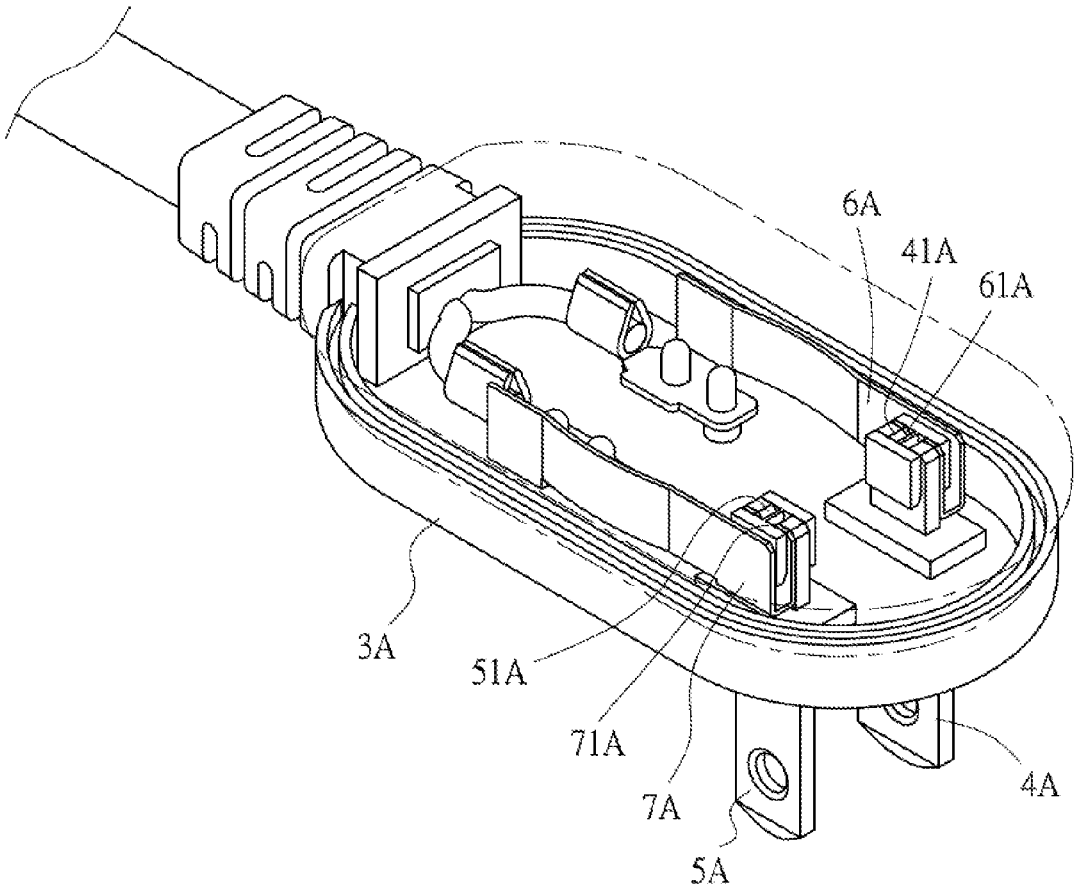
FIG. 10 shows a schematic view of that the present invention is applied to the plug, with that the live wire pin extends along a direction perpendicular to the direction along which the live wire extends, whereas the neutral wire pin extends along a direction perpendicular to the direction along which the neutral wire extends.

Referring to FIG. 10, in addition to being applied to the type of plug described above, the present invention can be also applied to another kind of plug. This kind of plug includes an insulative body 3A, a live wire pin 4A, a neutral wire pin 5A, a live wire 6A and a neutral wire 7A. The live wire pin 4A and the neutral wire pin 5A are disposed in the insulative body 3A and protruded out of the insulative body 3A. The live wire pin 4A and the neutral wire pin 5A are provided with a first groove 41A(51A) which is concaved in from an edge of the live wire pin 4A and the neutral wire pin 5A. The live wire 6A and the neutral wire 7A correspond respectively to the live wire pin 4A and the neutral wire pin 5A. The live wire 6A and the neutral wire 7A are provided with a second groove 61A(71A) corresponding to the first groove 41A(51A), and the second groove 61A(71A) is concaved in from an edge of the live wire 6A and the neutral wire 7A. The live wire pin 4A extends along a direction perpendicular to the direction along which the live wire 6A extends; whereas, the neutral wire pin 5A extends along a direction perpendicular to the direction along which the neutral wire 7A extends. This means that the first groove and the second groove fit with the type of the live wire pin and the live wire, as well as the type of the neutral wire pin and the neutral wire.

Figure 11:
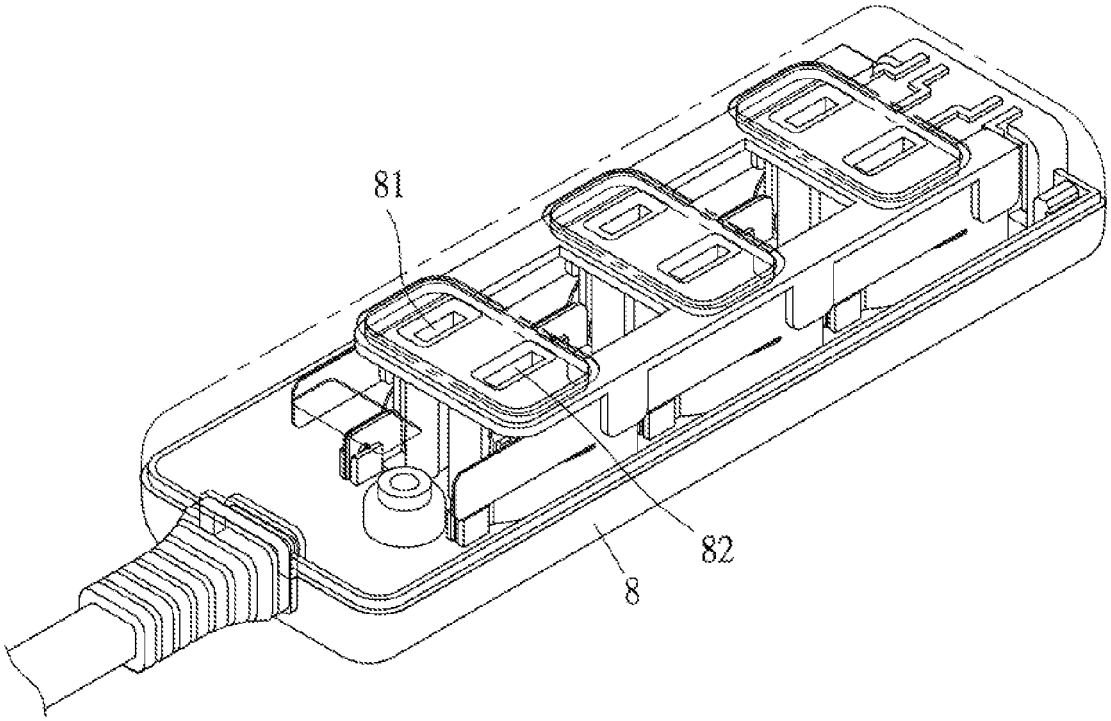
FIG. 11 shows a first schematic view of that the present invention is applied to a socket.
Figure 12:
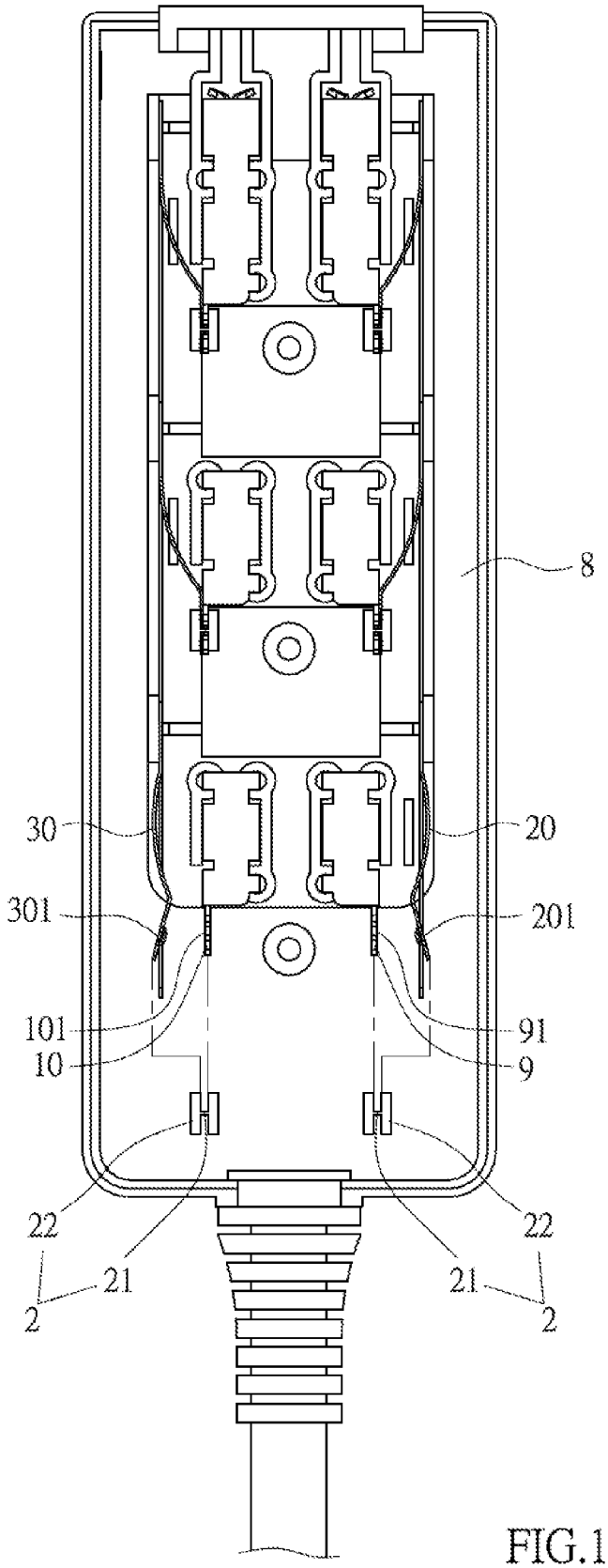
FIG. 12 shows a second schematic view of that the present invention is applied to the socket.

Referring to FIG. 11 and FIG. 12, the present invention is applied to overheat protection of a socket. The socket of the present embodiment includes an insulative body 8, a live wire insertion hole 81, a neutral wire insertion hole 82 opposite to the live wire insertion hole 81, a live wire terminal 9, a neutral wire terminal 10, a live wire 20 and a neutral wire 30.

The live wire terminal 9 is disposed in the insulative body 8 and corresponds to the live wire insertion hole 81. The neutral wire terminal 10 is disposed in the insulative body 8 and corresponds to the neutral wire insertion hole 82. The live wire terminal 9 and the neutral wire terminal 10 are provided with a first groove 91(101) which is concaved in from an edge of the live wire terminal 9 and the neutral wire terminal 10. The live wire 20 corresponds to the live wire terminal 9, and the neutral wire 30 corresponds to the neutral wire terminal 10. The live wire 20 and the neutral wire 30 are provided with a second groove 201(301) corresponding to the first groove 91(101), and the second groove 201(301) is concaved in from an edge of the live wire 20 and the neutral wire 30.

By putting the connection member 21 of the hot melt fixing member 2 into the first groove 91 and the second groove 201 of the live wire terminal 9 and the live wire 20, and using the stoppers 22 of the hot melt fixing member 2 to restrain the live wire terminal 9 and the live wire 20, the live wire terminal 9 and the live wire 20 can contact with each other to form a path. In addition, by putting the connection member 21 of the hot melt fixing member 2 into the first groove 101 and the second groove 301 of the neutral wire terminal 10 and the neutral wire 30, and using the stoppers 22 of the hot melt fixing member 2 to restrain the neutral wire terminal 10 and the neutral wire 30, the neutral wire terminal 10 and the neutral wire 30 can contact with each other to form a path. The connection member 21 will be melted when overheat, allowing the live wire terminal 9 and the live wire 20 to open, and the neutral wire terminal 10 and the neutral wire 30 to open by an elastic force between the live wire terminal 9 and the live wire 20, as well as an elastic force between the neutral wire terminal 10 and the neutral wire 30, thereby forming open circuit.

It is to be understood that the above description and drawings are only used for illustrating some embodiments of the present invention, not intended to limit the scope thereof. Any variation and deviation from the above description and drawings should be included in the scope of the present invention.

What is claimed is:

1. A conductive terminal, being used in association with a hot melt fixing member, comprising two conductive members, wherein each conductive member is provided with a groove, each groove is concaved in from an edge of the host conductive member, the grooves on the two conductive members are opposite to each other, a gap is maintained between the two conductive members by an elastic force between the two conductive members, the hot melt fixing member is put into the grooves of the two conductive members and is combined on the two conductive members to overcome the elastic force, allowing the two conductive members to form contact limit, the hot melt fixing member to be damaged when overheat, and the two conductive members to be opened by the elastic force to form open circuit.

2. The conductive terminal according to claim 1, wherein the groove is in a width of 0.1~1.3 cm.

3. The conductive terminal according to claim 2, wherein the groove width is 0.8 cm.

4. A conductive terminal comprising:

two conductive members, with each conductive member being provided with a groove, each groove being concaved in from an edge of the host conductive member, the grooves of the two conductive members being opposite to each other, and a gap being maintained between the two conductive members by an elastic force between the two conductive members; and a hot melt fixing member, with the hot melt fixing member being put into the grooves of the two conductive members and being combined on the two conductive members to overcome the elastic force, allowing the two conductive member to form contact limit, the hot melt fixing member to be damaged when overheat, and the two conductive members to be opened by the elastic force to form open circuit.

5. The conductive terminal according to claim 4, wherein an extended length of the part of the hot melt fixing member put into the groove is not larger than a depth of the groove.

6. The conductive terminal according to claim 4, wherein the groove is in a width of 0.1~1.3 cm.

7. The conductive terminal according to claim 6, wherein the groove width is 0.8 cm.

* * * * *